US008382550B2

(12) United States Patent
Kang

(10) Patent No.: US 8,382,550 B2
(45) Date of Patent: Feb. 26, 2013

(54) APPARATUS FOR ANIMATING DOLL USING ELECTROMAGNETS

(75) Inventor: Hyun Gu Kang, Gyeonggi-do (KR)

(73) Assignee: Hyun Gu Kang, Ansan-si, Gyeonggi-do (KR)

( * ) Notice: Subject to any disclaimer, the term of this patent is extended or adjusted under 35 U.S.C. 154(b) by 441 days.

(21) Appl. No.: 12/676,091

(22) PCT Filed: Sep. 4, 2008

(86) PCT No.: PCT/KR2008/005213

§ 371 (c)(1), (2), (4) Date: Mar. 2, 2010

(87) PCT Pub. No.: WO2009/031832

PCT Pub. Date: Mar. 12, 2009

(65) Prior Publication Data

US 2010/0197194 A1 Aug. 5, 2010

(30) Foreign Application Priority Data

Sep. 4, 2007 (KR) ..... 10-2007-0089451
Sep. 4, 2008 (KR) ..... 10-2008-0087079

(51) Int. Cl.
*A63H 3/20* (2006.01)

(52) U.S. Cl. ..... 446/359; 446/133; 446/330; 446/376

(58) Field of Classification Search ..... 446/376, 446/308, 330, 359, 133
See application file for complete search history.

(56) References Cited

U.S. PATENT DOCUMENTS 2,614,362 A * 10/1952 Zavala ..... 40/414
2,619,349 A * 11/1952 Abrahamson ..... 273/238
2,964,320 A * 12/1960 Lebrun ..... 273/108.53
3,318,043 A * 5/1967 Abbott ..... 446/133
4,570,092 A 2/1986 Ishimoto
4,889,027 A * 12/1989 Yokoi ..... 84/635
6,814,646 B2 * 11/2004 Atobe et al. ..... 446/267
6,887,121 B2 * 5/2005 Whitehead ..... 446/129

FOREIGN PATENT DOCUMENTS

JP 05-269259 A 10/1993
JP 2003-260274 A 9/2003
JP 2005-152439 A 6/2005

OTHER PUBLICATIONS

Written Opinion in International Application No. PCT/KR2008/005213, Feb. 26, 2009, pp. 1-3.

* cited by examiner

*Primary Examiner* — Gene Kim
*Assistant Examiner* — Joseph B Baldori
(74) *Attorney, Agent, or Firm* — Saliwanchik, Lloyd & Eisenschenk

(57) ABSTRACT

The present invention is such that a doll equipped with a plurality of auxiliary magnetic poles is inserted into a hermetically-sealed container filled with liquid and the container is circumferentially arranged with variable magnetic poles whose polarities are determined by electromagnets, whereby attraction or repulsion is applied on each portion of the doll. The polarity of each variable magnetic pole can be arbitrarily controlled by adjustment of direction of current flowing in the electromagnets to enable the doll in the container to be driven in various types of motions. Therefore, the motions of the doll can be expressed in various interesting types including dancing to the accompaniment of music without recourse to making the doll in a complicated robotic shape.

10 Claims, 6 Drawing Sheets

(a)

(b)

APPARATUS FOR ANIMATING DOLL USING ELECTROMAGNETS

CROSS-REFERENCE TO RELATED APPLICATIONS

This application is the U.S. national stage application of International Patent Application No. PCT/KR2008/005213, filed Sep. 4, 2008, which claims priority to Korean Application Nos. 10-2007-0089451, filed Sep. 4, 2007, and 10-2008-0087079, filed Sep. 4, 2008, the disclosures of each of which are incorporated herein by reference in their entirety.

TECHNICAL FIELD

The present invention relates to an apparatus for animating doll using electromagnets, and more particularly to an apparatus for animating doll using electromagnets capable of driving in various types of motions including dancing and the like the doll disposed in a hermetically-sealed container.

BACKGROUND ART

Various toys having not only a fixed shape but also capable of wobbling have been known. Most of the prior art wobbling toys are moved by mechanically articulated manipulation, and in order to make the toys dance to the accompaniment of music, complexity of mechanism involving a motor or gears is needed for moving articulations inside the doll. Research and development have advanced in moving legged multi-articulate bipedal mobile robots called 'humanoid robots' which mimic the human body mechanism and the motion of the human beings and are capable of walking, walking up stairs and performing dancing motions.

However, the legged mobile robots suffer from shortcomings in that the robots are prone to tumble failing to express excessive motions, and can express only simple foot steps with mostly arm movement. Numerous innovations for the legged robots have been provided in the prior art that will be described.

For example, U.S. Pat. Nos. 6,802,382, 7,053,577 and 7,061,200 teach a bipedal walking robot equipped with various sensors and actuators. The robots disclosed in these patents have a limit of mimicking only the motions of human beings. Moreover, the currently commercialized humanoid robots are very expensive, together with difficulties of using the humanoid robots as a concept of toy that dances. As a result, a mobile doll disposed inside liquid as an ornament or a toy capable of expressing a flexible and subtle motion has been disclosed.

Another example, U.S. Pat. No. 5,435,086 teaches an apparatus rotating a doll disposed in a liquid-contained vessel using a magnet, and other examples, U.S. Pat. Nos. 4,578,044, 5,272,681, 6,675,513 and 6,814,646 propose an apparatus operating in liquid a buoyed doll hung in a string by using magnetic force.

Still further examples, U.S. Pat. Nos. 5,301,444, 5,685,096 and 6,665,964 suggest one form of self-propelled fish-like aquatic toy capable of being freely driven through the water by outside magnetic force applied to a permanent magnet inserted therein.

These prior art toys or dolls thus explained suffer from shortcomings in that motions are very slow or toys are hung in a string to only perform a simple repeated motion, such that high complex and difficult movements including brake dances involving free stepping or rotations cannot be expressed.

DISCLOSURE OF INVENTION

Technical Problem

The present invention has been presented to solve the aforementioned shortcomings and it is an object of the present invention to provide an apparatus for animating doll using electromagnets capable of driving in various types of motions in detail and accurately the doll disposed in a hermetically-sealed container.

Technical Solution

In one general aspect, an apparatus for animating a doll using electromagnets is characterized by: a container filled with liquid in a hermetically sealed inner space; a doll disposed inside the container and equipped with one or more permanent magnets; a plurality of electromagnets arranged along a ring-shaped core, where polarity of each electromagnet is independently determined by a control current; a controller applying a control current to each of the plurality of electromagnets; a plurality of variable magnetic poles, each protruded from the core between neighboring electromagnets and arranged at a predetermined location of the container; and an electric power supplier supplying electric power to the controller.

Implementations of this aspect may include one or more of the following features.

The doll may further include one or more magnetic bodies (auxiliary magnetic poles) connected to the permanent magnets via electric wire.

The doll may have a shape of a human being and include permanent magnets vertically installed in the head and both feet, and auxiliary magnets installed at both elbows and both hands, each being connected to the permanent magnet of opposite foot via an electric wire.

The doll may further include auxiliary magnetic poles, each at both knees connected via an electric wire to a permanent magnet of the foot of the same side, where the polarity of sole direction of the permanent magnet installed at the right foot and that of the sole direction of the permanent magnet installed at the left foot are opposite.

The container may include a bottom-opened transparent cover of a predetermined form, a floor plate adhered to the opened portion of the cover for hermetically sealing an inner space of the cover, and a support case disposed with an inner space for accommodation and wrapping a part of the cover and the floor plate for supporting the container.

One or more variable magnetic poles may be arranged on a lower side of the floor plate and on an external surface of the cover.

Each distal end of the variable magnetic poles that faces the container may have a pointed shape to allow the magnetic force of the magnetic poles to be concentrated toward a predetermined area.

The liquid may be constituted by using degassed liquid added with sterilizer for preventing erosion.

The electric power supplier may supply electricity through one or more external electric power sources or dry batteries.

The apparatus for animating doll using electromagnets may include a sound storage for storing sound data and a sound reproducer processing the sound data stored in the sound storage and generating a signal to be outputted through a speaker.

The apparatus for animating doll using electromagnets may further include one or more speaker output port or speaker, where the speaker output port transmits the signal generated by the sound reproducer to an external speaker and the speaker outputs the signal generated by the sound reproducer.

The apparatus for animating doll using electromagnets may further include a sound sensor detecting sound and an analogue-to-digital (A/D) converter converting the sound detected by the sound sensor to a digital signal, where the controller applies a control current to each electromagnet in response to the signal converted by the A/D converter.

The apparatus for animating doll using electromagnets may further include one or more light sources irradiating light in response to a light source control signal and a light source controller transmitting the light source control signal to each light source in response to the digital signal converted by the A/D converter.

ADVANTAGEOUS EFFECTS

There are advantageous effects in the apparatus for animating doll using electromagnets according to the present invention in that magnetic force for driving the doll inside the hermetically sealed container can be easily produced by electromagnets, and each portion of the doll can be applied with attraction and repulsion to allow a detailed control of the doll.

The human-like doll enables itself to express a dancing motion like that of human being to the accompaniment of music without taking the shape of a complicated robot, and further enables itself to conduct a brake dance and other very difficult dancing motions.

Particularly, if electromagnetic control for driving the doll is conducted to the accompaniment of sound, mutually different motions can be expressed according to the types of music, and if the doll is driven along with light and sound, the motions of the doll can produce more dynamic effects.

BEST MODE FOR CARRYING OUT THE INVENTION

The present invention now will be described more fully hereinafter with reference to the accompanying drawings, in which exemplary implementations of the invention are shown.

First of all, it will be understood that terms and phrases used in the specification and claims should be interpreted as having meanings that are consistent with their meanings in the context of the relevant art and will not be interpreted in an idealized or overly formal sense or those defined in commonly used dictionaries unless expressly so defined herein.

It will be further understood that the disclosed implementations are merely exemplary, which can be embodied in various alternate forms. Therefore, specific structural and functional details disclosed herein are not to be interpreted as limiting, but merely as a basis for the claims and as a representative basis for teaching one skilled in the art to variously employ the implementations of the present invention in virtually any appropriately detailed structure. The scope of the invention is limited only by the claims and the invention encompasses numerous alternatives, modifications and equivalents.

Figure 1:
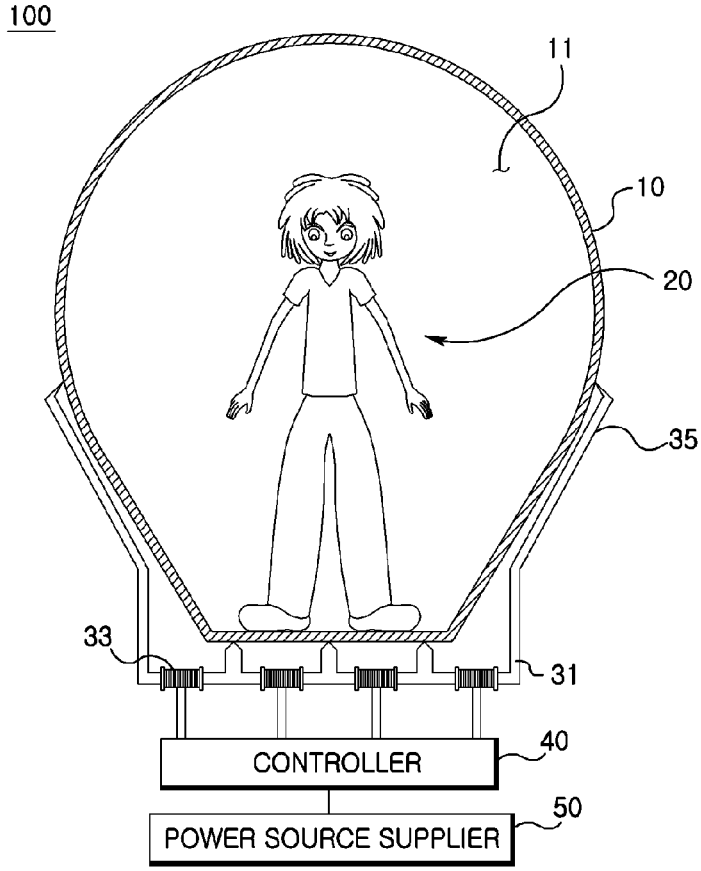
FIG. 1 is an exemplary implementation of an apparatus for animating doll using electromagnets according to the present invention.

Referring to FIG. 1, an apparatus (100) for animating doll using electromagnets may include a container (10) filled with liquid in a hermetically sealed inner space (11), a doll (20) disposed inside the container (10), a plurality of electromagnets (33), a plurality of variable magnetic poles (35), a controller (40) and an electric power supplier (50).

The container (10) may take various shapes such as round type, dome type and cylindrical shape.

Now, referring to FIG. 2, an exemplary container (10) will be described, which includes a round cover (10-1), a floor plate (10-2) and a support case (10-3).

The cover (10-1) may be constituted with a transparent material having a lower section partially opened. The transparent or semi-transparent material may be plastic material or glass material such as polyethylene, polypropylene and polycarbonate.

The floor plate (10-2) serves to hermetically seal an inner space of the cover (10-1) by being adhered to the opened portion of the cover (10-1). The support case (10-3) serves to wrap a part of the cover (10-1) and the floor plate (10-2) and to support the container itself, and is disposed with an inner space for accommodating various parts used for driving the doll (20).

The cover (10-1) and the floor plate (10-2) may be coupled to the support case (10-3) in various manners. For example, the cover (10-1) is formed thereunder with a screw and the support case (10-3) is formed with a groove to mesh with the screw formed at the bottom of the cover (10-1), whereby the cover (10-1) and the support case (10-3) may be coupled by screwing or separated by unscrewing.

The liquid filled in a space (11) of the container may be admixed with sterilizer for preventing erosion caused by, for example, propagation of fungi or microorganisms. The liquid may be degassed liquid for preventing dissolved gas from being changed to air bubbles in response to temperature changes. Furthermore, the liquid may be water innocuous to human body. At this time, it is preferable that the water be the one having a low viscosity for facilitating the motion of the doll. The liquid may be colorless liquid or colored liquid.

The doll (20) may take any form such as that of an animal, a plant or an object according to the need. The doll (20) is installed with one or more permanent magnets. The doll (20) may be installed with one or more magnetic bodies (hereinafter referred to as auxiliary magnetic poles) connected to the permanent magnet via an electric wire. The magnetic body herein referred to is a material that is supposed to have a magnetic property caused by the permanent magnet connected via the electric wire, an example of which may be a metal plate that can be magnetized. The auxiliary magnetic poles connected to the permanent magnet are formed with magnetic poles. The permanent magnet may be NdFeB magnet having a strong magnetic force.

The doll may have a plurality of electromagnets (33), and each electromagnet is arranged along a ring-shaped core (31), the polarity of the electromagnet being individually determined by a control current. In other words, the polarity of relevant electromagnet is determined by direction of the control current flowing in each electromagnet.

The controller (40) serves to apply a control current to each electromagnet. The controller (40) receives the electric power from the electric power supplier (50) and applies the control current to enable each electromagnet to have a corresponding polarity. The electric power supplier (50) may use an external power source or a dry battery to supply the electric power, and may include a switch for turning on and off the electric power.

Meanwhile, the variable magnetic pole (35) may comprise a plural structure to be protruded from a core between neighboring electromagnets and arranged at each area of the container (10).

Figure 3:
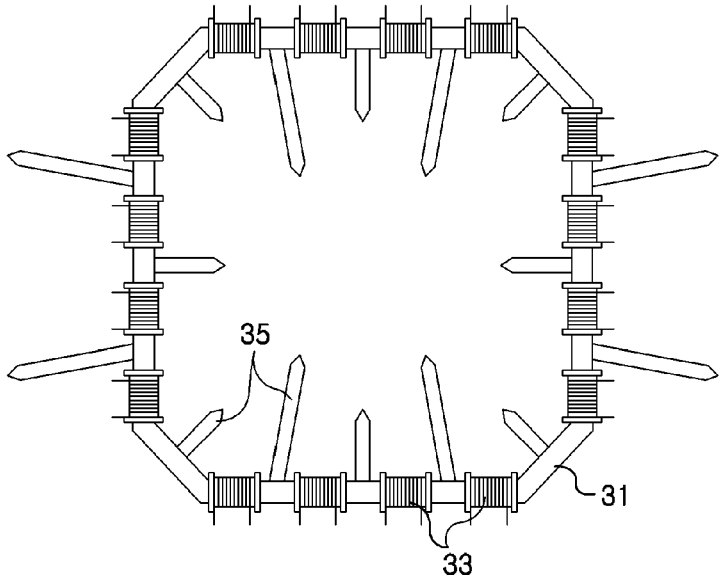
FIG. 3 is a detailed exemplary implementation of variable magnetic poles according to the present invention.

Referring to FIG. 3, a plurality of electromagnets (33) is aligned along the ring-shaped core (31). A distal end of the variable magnetic pole (35) is connected at between the neighboring electromagnets, and the other distal end of the variable magnetic pole (35) is arranged about the container (10). Each distal end of the variable magnetic poles (35) that faces the container (10) may have a pointed shape to allow the magnetic force of the magnetic poles to be concentrated toward a predetermined area. Although FIG. 3 has shown an alignment where 16 electromagnets (33) and 16 variable magnetic poles (35) are respectively arranged on the core (31), the number of electromagnets (33) and variable magnetic poles (35) may be variably configured according to the need.

Mode for the Invention

Figure 4:
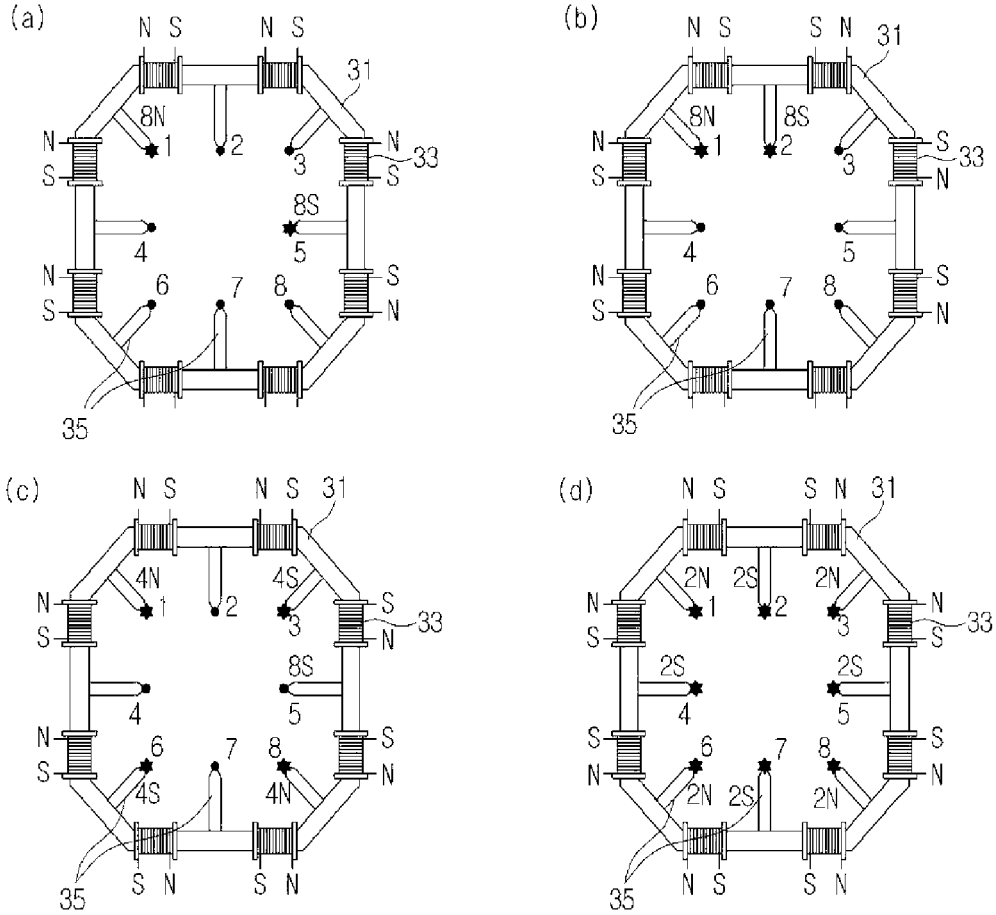
FIG. 4 is a rendition of magnetic poles formed at variable magnetic poles according to state of each electromagnet.

Referring to FIG. 4, polarity of each variable magnetic pole will be described through an example where 8 electromagnets and 8 variable magnetic poles are respectively arranged on the core.

The controller (40) may apply a control current to allow the illustrated polarity to be shown on each electromagnet, where the variable magnetic poles formed with N pole or S pole are shown with asterisks. The polarity appears only on a variable magnetic pole between same-polarity neighboring opposite electromagnets, but polarity on other variable magnetic poles is not shown.

Referring to FIG. 4*a,* a control current having a same direction is applied to 5 electromagnets out of 8 electromagnets, and the remaining 3 electromagnets are applied with a control current of opposite direction. As a result, only first and fifth variable magnetic poles are formed with N pole and S pole respectively. At this time, strength of magnetic force on the first and fifth variable magnetic poles is larger than that of an individual electromagnet, i.e., approximately 8 times than that of the individual electromagnet.

Now, referring to FIG. 4*b*, a control current having a same direction is applied to 7 electromagnets out of 8 electromagnets, and the remaining one electromagnet is applied with a control current of opposite direction. As a result, only first and second variable magnetic poles are formed with N pole and S pole respectively. At this time, strength of magnetic force on the first and sixth variable magnetic poles is larger than that of an individual electromagnet, i.e., approximately 8 times than that of the individual electromagnet.

Referring to FIG. 4C, a control current is applied in such a manner that two adjacent electromagnets out of 8 electromagnets have the same pole direction and each electromagnet pair is changed of its pole direction. Then, first variable magnetic pole, third variable magnetic pole, sixth variable magnetic pole and eighth variable magnetic pole are respectively formed with N pole, S pole, S pole and N pole. At this time, strength of magnetic force on the first, third, sixth and eighth variable magnetic poles is larger than that of an individual electromagnet, i.e., approximately 4 times than that of the individual electromagnet.

Referring to FIG. 4*d,* a control current is applied in such a fashion that alternatively aligned electromagnets out of 8 electromagnets have the same pole direction. Then, all the 8 electromagnets are formed with poles. At this time, strength of magnetic force on each variable magnetic pole is larger than that of an individual electromagnet, i.e., approximately 2 times than that of the individual electromagnet.

As noted above, an appropriate adjustment of direction of current flowing in each electromagnet makes it possible to supply the magnetic force of desired pole to the desired variable magnetic pole, and positions expressed by the poles can be sequentially changed over time. As a result, the permanent magnets and auxiliary magnetic poles disposed at the doll can be applied with attraction and repulsive force to enable a free control of various movements including the dancing movement.

Now, exemplary implementations using the human-like doll will be described in detail.

The doll (20) may be firstly configured in such a way that the doll is in a neutral buoyed state in the liquid filled in the inner space (11) of the container (10), i.e., in a state of the doll not floating nor in a submerged state.

Figure 5:
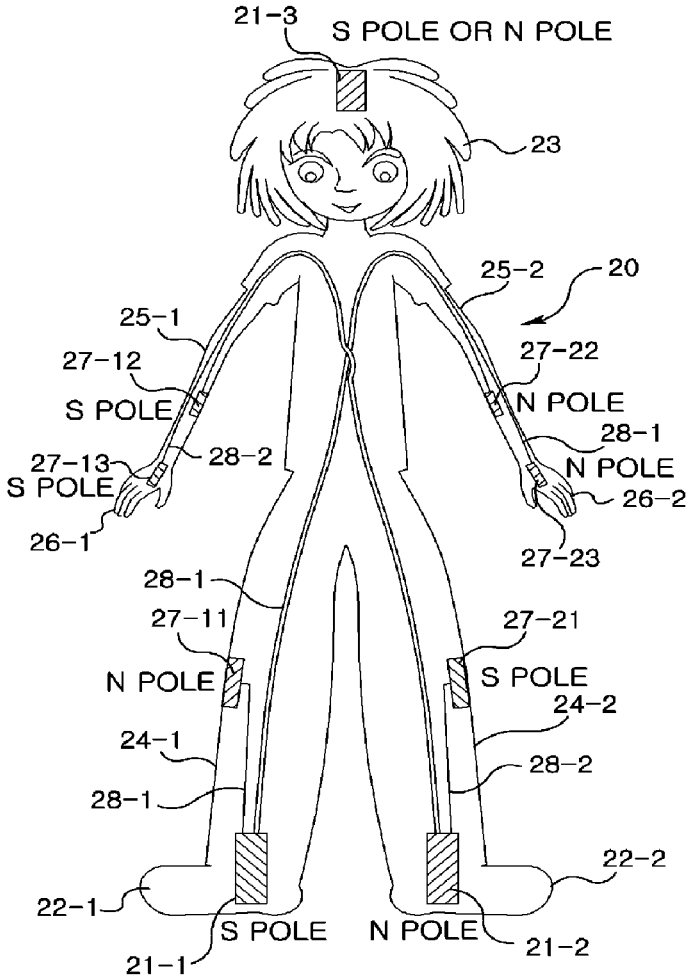
FIG. 5 is a detailed exemplary implementation of a doll according to the present invention.

Referring to FIG. 5, permanent magnets (21-1, 21-2) are vertically equipped on the head (23) and both feet (22-1, 22-2) of the doll (20). Furthermore, both elbows (25-1, 25-2) and both hands (26-1, 26-2) are mounted with auxiliary magnetic poles connected to the permanent magnets of the opposite feet via an electric wire, and both knees (24-1, 24-2) are equipped with auxiliary magnetic poles connected to permanent magnets of foot of the same direction. At this time, the pole toward the sole of the permanent magnet (21-1) aligned at the right foot (22-1) is made to be opposite to the pole toward the sole of the permanent magnet (21-2) aligned at the left foot (22-2).

In other words, if the permanent magnet (21-1) is so aligned as to allow the right sole side of the doll (20) to have S pole, the permanent magnet (21-2) is so aligned as to allow the left sole side to have N pole. The polarity of the permanent magnet (21-3) vertically arranged on the head (23) of the doll (20) may be arbitrarily established according to the need.

Referring again to FIG. 5, the permanent magnet (21-1) equipped at the right foot (22-1) is connected to auxiliary magnetic poles arranged on the right knee (24-1), the left elbow (25-2) and the left hand (26-2) via an electric wire (28-1), such that each auxiliary magnetic pole (27-11, 27-22, 27-23) arranged on the right knee (24-1), the left elbow (25-2) and the left hand (26-2) are formed with N pole.

Furthermore, the permanent magnet (21-2) mounted at the left foot (22-2) is connected to auxiliary magnetic poles mounted on the left knee (24-2), the right elbow (25-1) and the right hand (26-1) via an electric wire (28-2), such that each auxiliary magnetic pole (27-21, 27-12, 27-13) installed at the left knee (24-2), the right elbow (25-1) and the right hand (26-1) is formed with S pole.

Figure 2:
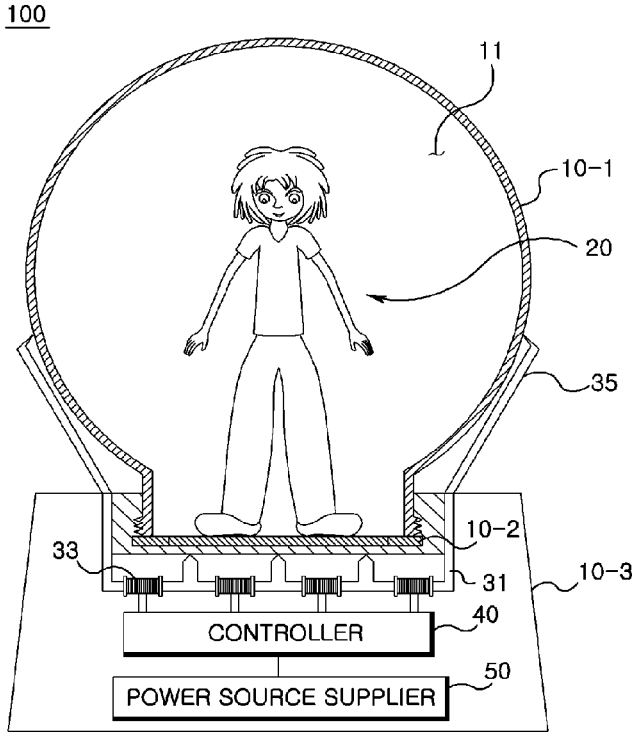
FIG. 2 is a detailed exemplary implementation of a container according to the present invention.

Meanwhile, the variable magnetic pole (35) in the exemplary implementation illustrated in FIG. 2 may be arranged at a lower side of the floor plate (10-2) and a predetermined portion of the cover (10-1).

Figure 6:
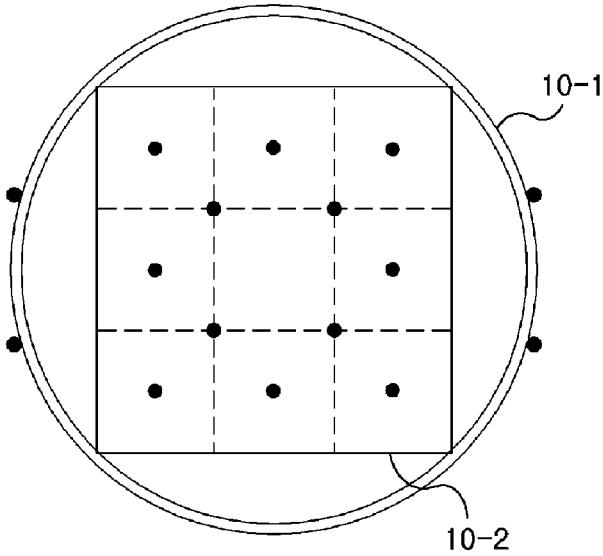
FIG. 6 is a rendition of arranged variable magnetic poles according to the present invention.

Now, referring to FIG. 6, arrangement of variable magnetic pole (35) will be exemplified.

The floor plate (10-2) is equally divided into 9 squares, and 8 squares except for a center square are centrally arranged with variable magnetic poles. Thereafter, each apex of the center square is arranged with a variable magnetic pole. The cover (10-1) is circumferentially arranged with 4 variable magnetic poles. Each point is a location where a pointed distal end of the variable magnetic pole is positioned. The 4 variable magnetic poles arranged at each apex of the center square are intentionally arranged as places for an erect doll (20) to sway its body by pacing in short steps in back and forth directions, and diagonal directions, and the 4 variable magnetic poles arranged at the cover (10-1) may be used for the doll (20) to rotate in a large swing when the doll (20) collapses or falls.

Figure 7:
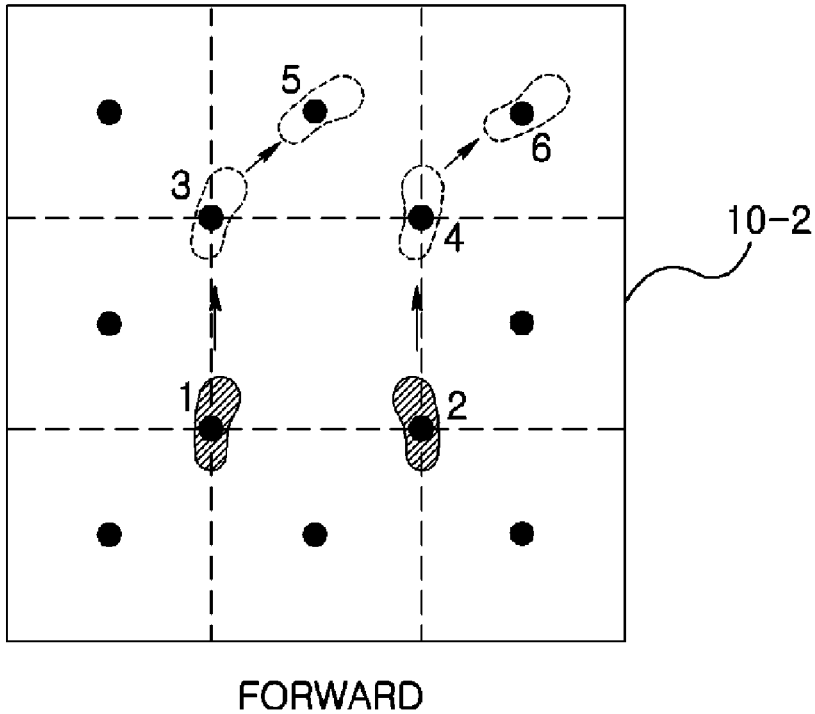
FIG. 7 is an exemplary method of advancing or reversing a doll according to the present invention.
Figure 7:
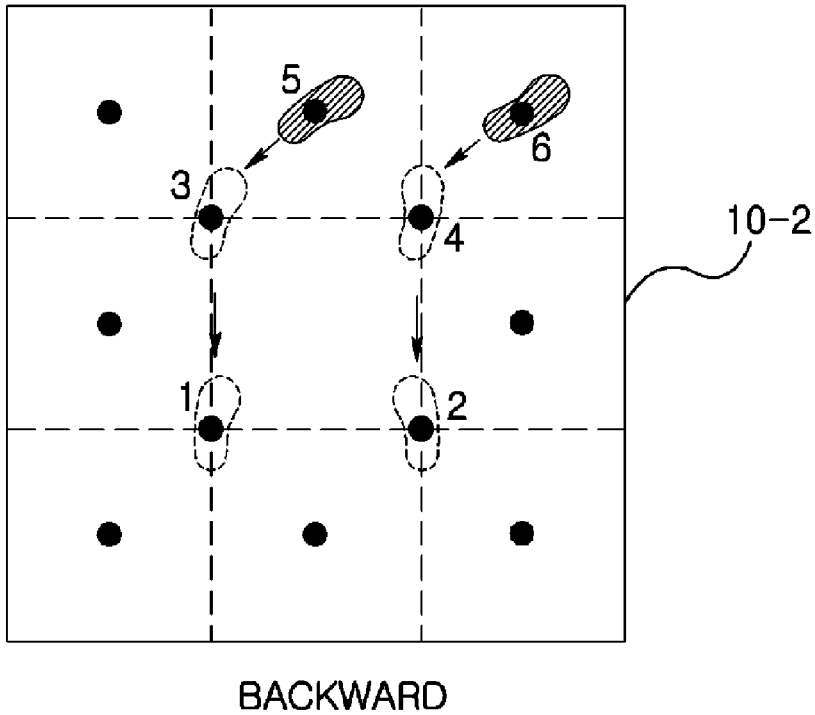

Now, referring to FIG. 7, a driving state of the doll (20) will be described with reference to the arranged variable magnetic poles.

FIG. 7*a* illustrates a method in which the doll (20) is sequentially moving in forward steps toward arrow directions from initial positions (1,2) to next positions (3,4) and (5,6) of the variable magnetic poles in which attraction can be applied to the permanent magnets (21-1, 21-2) installed at both feet of the doll (20).

FIG. 7*b* illustrates a method in which the doll (20) is sequentially moving in backward steps toward arrow directions from initial positions (5,6) to next positions (3,4) and (1,2) of the variable magnetic poles in which attraction can be applied to the permanent magnets (21-1, 21-2) installed at both feet of the doll (20).

Figure 8:
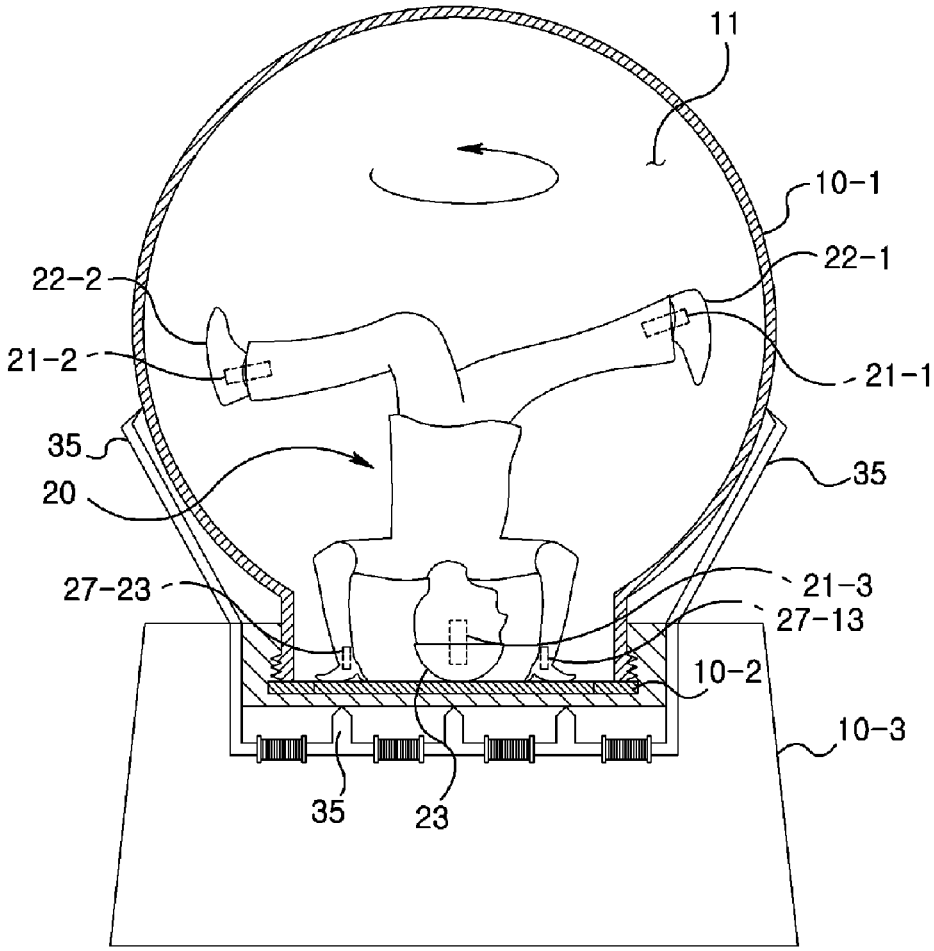
FIG. 8 is a rendition of a doll doing a head-standing according to the present invention.

FIG. 8 is a rendition of a doll (20) doing a head-standing according to the present invention.

To this end, the doll (20) is arranged in such a way that attraction is generated between relevant variable magnetic poles positioned at the permanent magnet (21-3) on the head (23) and the floor plate (10-2), and attraction is also generated between relevant variable magnetic poles and the auxiliary magnetic poles (27-13, 27-23) on both hands of the doll (20). Furthermore, if the variable magnetic poles arranged to wrap the cover (10-1) is made to apply attraction to the permanent magnets (21-1, 21-2) of both feet (22-1, 22-2) of the doll (20), the doll (20) takes the head-standing position for head-spin movement.

At this time, if the magnetic poles formed at each variable magnetic pole arranged to wrap the cover (10-2) are sequentially changed, the doll (20) rotates to perform the head-spinning. As explained above, if the magnetic poles formed at each variable magnetic pole are appropriately altered, the doll (20) can be driven to take a variety of motions including brake dance which is similar to the dancing motion of a human being.

Figure 9:
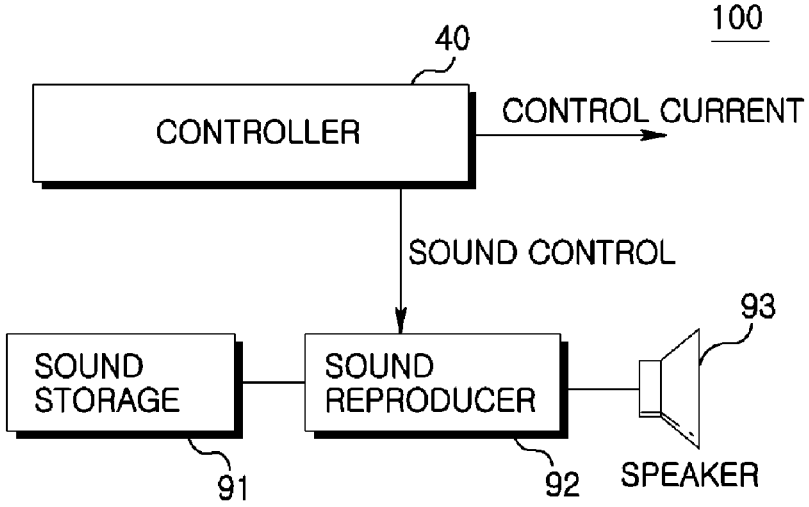
FIGS. 9 and 10 illustrate other exemplary implementations of an apparatus for animating doll using electromagnets according to the present invention.

Referring to FIG. 9, an apparatus (100) for animating doll using electromagnets may further include a sound storage (91) and a sound reproducer (92), whereby sounds may be outputted along with motions of the doll (20).

The sound storage (91) is a constituent element for storing a digital-type sound data (i.e., MP3 file), and the sound reproducer (92) serves to process the sound data stored in the sound storage (91) and generate a signal to be outputted via a speaker (93).

The controller (40) may control the sound reproducer (92) to process the sound data stored in the sound storage (91), in addition to the function of applying a control current to each electromagnet (33). The controller (40) may cooperate with a switch (not shown) for determining whether to reproduce the sound.

The apparatus (100) for animating doll using electromagnets in the present implementation may be installed with a speaker output port (not shown) for transmitting to an outside speaker the signal generated by the sound reproducer (92) and may cooperate with the outside speaker.

Figure 10:
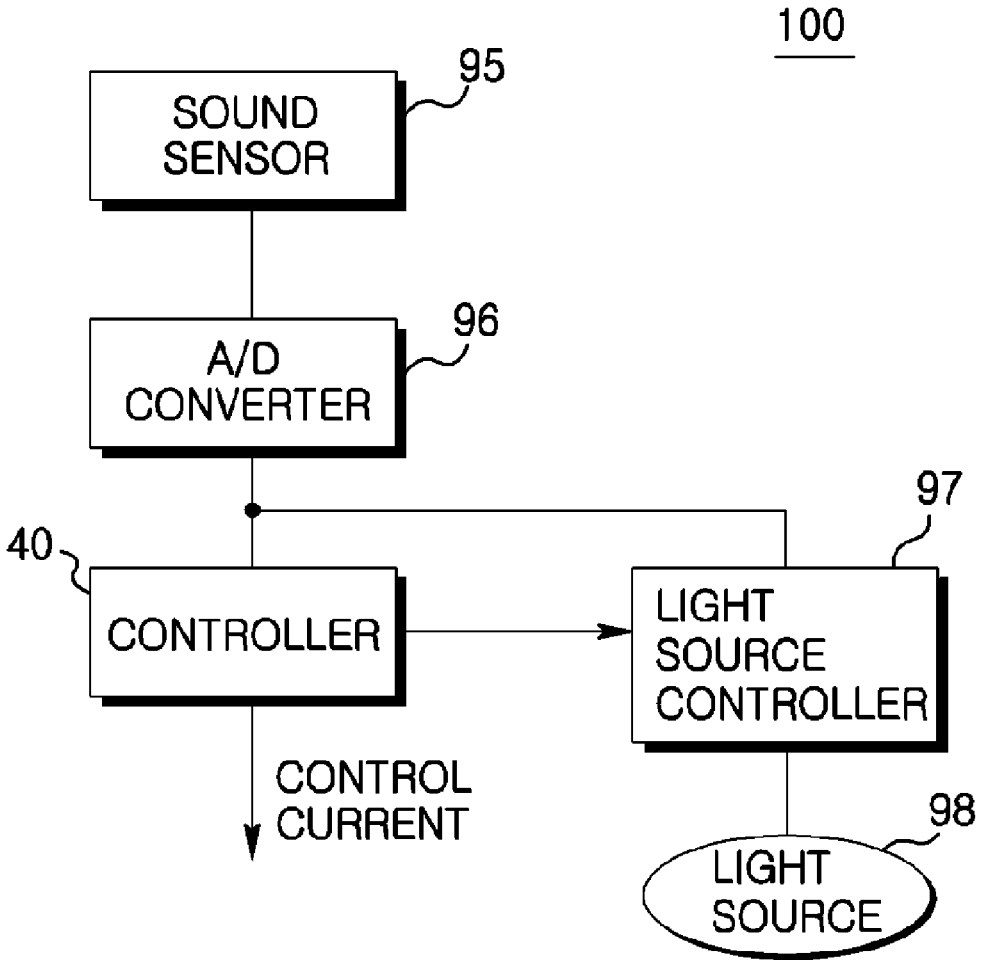

Referring to FIG. 10, the apparatus (100) for animating doll using electromagnets may further include a sound sensor (95) and an Analogue to Digital (A/D) converter (96), and may drive the doll (20) according to the sound.

In other words, if the sound sensor (95) senses a sound, the A/D converter (96) converts the sound sensed by the sound sensor (95) to a digital signal and transmits the digital signal to the controller (40), where the controller (40) applies the control current to each electromagnet in response to the digital signal inputted from the A/D converter (96). As a result, the motion of the doll (20) is determined by the types of sounds thus detected.

The apparatus (100) for animating doll using electromagnets according to the instant implementation may further include a light source (98) and a light source controller (97), whereby special visual effects can be carried out.

The light source (98) is a constituent element for irradiating lights of various colors, and the light source controller (97) controls the operation of the light source (98) in response to the signal digitalized by the A/D converter (96) to emit various different colors of lights in response to the sounds. Consequently, the doll (20) is made to dance to the accompaniment of music preferred by a user, and the music may be heard with a special visual feeling from the light to thereby have an interesting effect. The light may be used as a means for illuminating the doll (20).

Industrial Applicability

The apparatus for animating doll using electromagnets according to the present invention may be applied to an industry in view of the fact that the magnetic force for driving the doll inside the hermetically sealed container can be easily produced by electromagnets, and each portion of the doll can be applied with attraction and repulsion to allow a detailed control of the doll, where the human-like doll enables itself to express a dancing motion like that of human being to the accompaniment of music without taking the shape of a complicated robot, and further enables itself to conduct a brake dance and other very difficult dancing motions. Particularly, if electromagnetic control for driving the doll is conducted to the accompaniment of sound, mutually different motions can be expressed according to the types of music, and if the doll is driven along with light and sound, the motions of the doll can produce more dynamic effects.

The invention claimed is:

1. An apparatus for animating a doll using electromagnets is characterized by:

a container filled with liquid in a hermetically sealed inner space, and including a bottom-opened transparent cover of a predetermined form, a floor plate adhered to the opened portion of the cover that hermetically seals an inner space of the cover, and a support case disposed with an inner space that accommodates and wraps a part of the cover and the floor plate and that supports the cover and the floor plate;

a doll disposed inside the cover of the container, wherein the doll has a shape of a human being and includes permanent magnets vertically installed in the head and both feet, and auxiliary magnets installed at both elbows and both hands, each being connected to the permanent magnet of opposite foot via an electric wire;

a plurality of electromagnets arranged along a ring-shaped core disposed at a lower surface of the floor plate of the container, where polarity of each electromagnet is independently determined by a control current;

a plurality of variable magnetic poles, each protruded and extended from the core between neighboring electromagnets and each one or more variable magnetic poles arranged at a lower surface of the floor plate and an external surface of the cover;

a controller applying different control currents to the plurality of electromagnets to allow each of the variable magnetic poles to have a different magnetic force at different times, whereby attractive forces and repulsive forces are provided to the permanent magnets and the auxiliary magnets of the doll; and an electric power supplier supplying electric power to the controller.

2. The apparatus as claimed in claim 1, characterized in that the doll further includes auxiliary magnetic poles, each at both knees connected via an electric wire to a permanent magnet of the foot of the same side.

3. The apparatus as claimed in claim 1, characterized in that the polarity of sole direction of the permanent magnet installed at the right foot and that of the sole direction of the permanent magnet installed at the left foot are opposite.

4. The apparatus as claimed in claim 1, characterized in that each distal end of the variable magnetic poles that faces the container has a pointed shape.

5. The apparatus as claimed in claim 1, characterized in that the liquid is constituted by using degassed liquid added with sterilizer for preventing erosion.

6. The apparatus as claimed in claim 1, characterized in that the electric power supplier supplies electricity through one or more external electric power sources or dry batteries.

7. The apparatus as claimed in claim 1, characterized in that the apparatus includes a sound storage for storing sound data and a sound reproducer processing the sound data stored in the sound storage and generating a signal to be outputted through a speaker.

8. The apparatus as claimed in claim 7, characterized in that the apparatus further includes one or more speaker output ports and speakers.

9. The apparatus as claimed in claim 1, characterized in that the apparatus further includes a sound sensor detecting sound and an analogue-to-digital (AID) converter converting the sound detected by the sound sensor to a digital signal, where the controller applies a control current to each electromagnet in response to the signal converted by the AID converter.

10. The apparatus as claimed in claim 9, characterized in that the apparatus further includes one or more light sources irradiating light in response to a light source control signal and a light source controller transmitting the light source control signal to each light source in response to the digital signal converted by the AID converter.

* * * * *